US006537113B1

(12) United States Patent
Chen

(10) Patent No.: US 6,537,113 B1
(45) Date of Patent: Mar. 25, 2003

(54) STRUCTURE OF PIN FOR AC CONNECTOR AND PROCESS FOR FASTENING WIRE ONTO SAME

(75) Inventor: Chen Chun Chen, Taoyuan (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/056,239

(22) Filed: Jan. 23, 2002

(51) Int. Cl.[7] ..... H01R 9/24
(52) U.S. Cl. ..... 439/888; 439/76.1
(58) Field of Search ..... 439/888, 76.1, 439/79, 83, 874, 77, 78, 877, 876, 878; 228/173.5; 29/850

(56) References Cited

U.S. PATENT DOCUMENTS 1,105,889 A * 8/1914 Day ..... 439/458
1,255,310 A * 2/1918 Henderson ..... 439/888
1,832,757 A * 11/1931 De Saunier ..... 439/738
1,875,241 A * 8/1932 Idank ..... 439/888
2,668,279 A * 2/1954 Epstein ..... 439/865

* cited by examiner

*Primary Examiner*—Renee Luebke
*Assistant Examiner*—Ross Gushi
(74) *Attorney, Agent, or Firm*—Kirton & McConkie; Michael F. Krieger

(57) ABSTRACT

A structure of the AC connector is provided. The structure includes a main body, at least one terminal, at least one pin, and at least one wire. The at least one terminal is located in a cave of the main body for accepting a power supply. The at least one pin electrically connected with the at least one terminal, wherein each pin has a hole and a wire-securing part. Each of the at least one wire has a first end connected to the wire-securing part and a second end electrically connected to a circuit board, wherein the first end penetrates through the hole and is wrapped around the wire-securing part for at least one turn.

17 Claims, 5 Drawing Sheets

STRUCTURE OF PIN FOR AC CONNECTOR AND PROCESS FOR FASTENING WIRE ONTO SAME

BACKGROUND

Related Applications

This application claims priority to Taiwan application Serial No. 090133322 filed Dec. 31, 2001.

FIELD OF THE INVENTION

The present invention relates to a structure of a pin, and more particularly to a structure of a pin for an AC connector. The present invention also relates to a process for fastening a wire onto the pin.

BACKGROUND OF THE INVENTION

The power supply apparatus, such as an adapter, is widely used for rectifying and converting AC power into DC power. FIGS. 1(*a*) and 1(*b*) are respectively exploded and illustrate perspective views of a conventional power supply apparatus. Such power supply apparatus includes an upper housing 1 and a lower housing 2. A space is defined between the upper housing 1 and the lower housing 2 for accommodating a circuit board 3 therein. An AC connector 4 and other electronic components 30 required for the power supply apparatus are mounted on the circuit board 3. A first concave 11 and a second concave (not shown) are respectively provided on the front side and the rear side of the upper housing 1. A third concave 21 and a fourth concave 22, opposite to the first concave 11 and the second concave, are respectively provided on the front side and the rear side of the lower housing body 2. When the upper housing 1 and the lower housing 2 are jointed together, the first concave 1 and the third concave 21 form a slot for infixing the AC connector 4 therein to receive an external AC power supply. The circuitry mounted on the circuit board 3 converts the AC power into a DC power supply, and the converted DC power is supplied to electrical appliances such as printers, radios, and modems.

Referring to FIGS. 2(*a*) and 2(*b*), the AC connector 4 basically includes an insulating main body 40, two power terminals 411, 412, and a ground terminal 413. The power terminals 411, 412, and ground terminal 413 are located in a cave 41 inside the main body 40 and penetrate through the apertures (not shown) on the backside surface 401 of the main body 40. The power terminals 411, 412, and 413 are respectively coupled with the pins 431, 432, and 432 via rivets 421, 422, and 423.

There are two supporting rods 44 extending from a bottom surface 402 of the main body 40. These two supporting rods 44 are integrally formed with the main body 40 by plastic injection molding technique. A protruding member 433 is defined at the free end of each supporting rod 44, wherein the maximum transversal length of the protruding member 433 is slightly larger than the diameter of each cavity 33 and 34 (FIG. 1(*a*)) on the circuit board 3. Since the supporting rod 44 is made of a plastic material with an inherent elasticity, the protruding members 433 can penetrate through the cavities 33 and 34 by exerting an external force thereto. The AC connector 4 can be fixed to the circuit board 3 accordingly.

The power pins 431 and 432 are simultaneously inserted into the corresponding pinholes 31 and 32 on the circuit board 3 (FIG. 1(*a*)), and subsequently fixed to the circuit board 3 by a welding technique. The power terminals 411 and 412 are utilized to accept electrical signals from the AC power supply through the power pins 431, 432 into the circuit board 3. The ground terminal 413 is used for accepting ground signal from the AC power supply. The ground pin 433 will be grounded to a ground voltage on the circuit board 3 via a wire (not shown).

However, the above-mentioned AC connector still has some disadvantages in practice:

1. Since the distance between the pinholes 31 and 32 has to be predetermined depending on the distance between the power pins 431 and 432, the use of such AC connector 4 is restricted to some specified circuit boards; and
2. Since the power pins 431 and 432 are made of hard metals, after they are positioned on the circuit board 3, a portion of the solder by welding technique might be stripped due to the thermal stress produced from the electronic components 30 in operation.

Therefore, the present invention provides an improved pin structure for an AC connector so as to overcome the problems described above.

SUMMARY AND OBJECTS OF THE INVENTION

In accordance with an aspect of the present invention, there is provided a structure of a connector. The structure includes a main body, at least one terminal, at least one pin and at least one wire. The at least one terminal is located in a cave of the main body for accepting a power supply. The at least one pin electrically connected with the at least one terminal, wherein each pin has a hole and a wire-securing part. Each of the at least one wire has a first end connected to the wire-securing part and a second end electrically connected to a circuit board, wherein the first end penetrates through the hole and is wrapped around the wire-securing part for at least one turn.

In an embodiment, the first end includes a bare part and partially an insulated part, wherein the bare part is uncovered, and the insulated part is covered with an insulating material.

In an embodiment, the connector further includes at least one supporting rod extending from a bottom surface of the main body for being positioned on the circuit board. Preferably, the supporting rod is integrally formed with the main body.

In an embodiment, the connector further includes at least one projecting plate depending on the wire-securing part. Preferably, the projecting plate is integrally formed with the main body.

Preferably, the pin is a power pin and the terminal is a power terminal. Certainly, the pin and the terminal can be a ground pin and a ground terminal, respectively.

In accordance with another aspect of the present invention, there is provided a structure of an AC connector. The AC connector includes a main body, at least one power terminal located in a cave of the main body for accepting an AC power supply, at least one power pin electrically connected with the at least one terminal, wherein each of the power pins having a hole and a wire-securing part. The connector further includes at least one wire, each wire having a first end connected to the wire-securing part and a second end electrically connected to a circuit board, wherein the first end penetrates through the hole and is wrapped around the wire-securing part for at least one turn.

In accordance with another aspect of the present invention, there is provided a process for fastening a wire onto a pin, wherein the pin has a hole and a wire-securing part, and the wire has an end with a bare part and an insulated part. The process includes steps of penetrating the bare part and a portion of the insulated part through the hole, allowing the bare part to be wrapped around the wire-securing part for at least one turn, and fixing the bare part onto the wire-securing part.

Preferably, the bare part is fixed onto the wire-securing part by welding.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE PREFERRED EMBODIMENTS

Figure 1A:
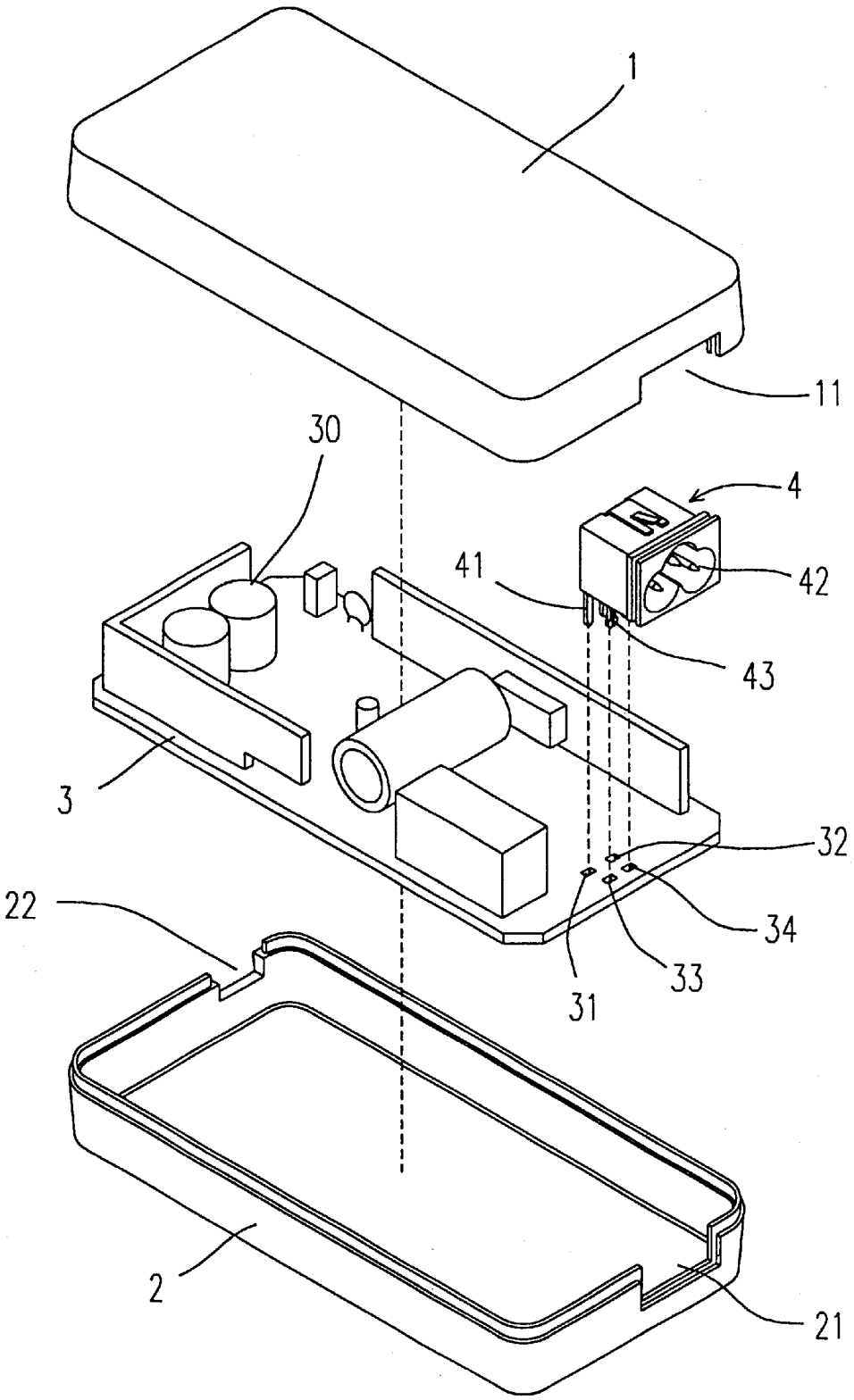
Fig. 1(a)(PRIOR ART)
FIGS. 1(*a*) and 1(*b*) are respectively exploded and perspective views of a conventional power supply apparatus.
Figure 1B:
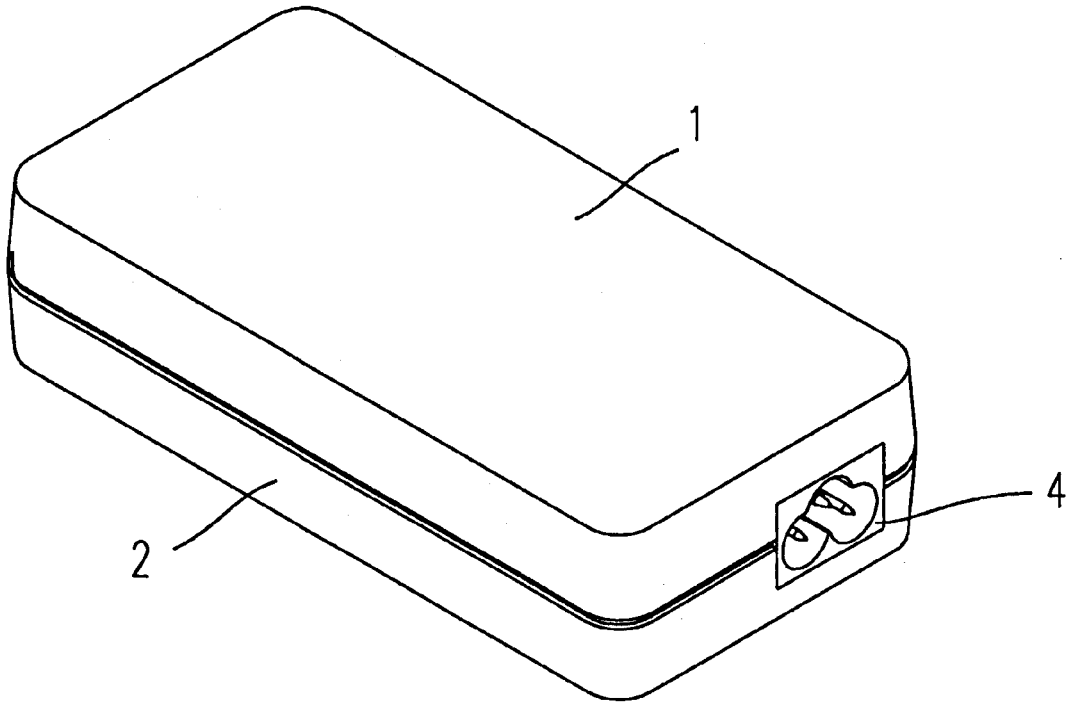
Fig. 1(b)(PRIOR ART)
Figure 2A:
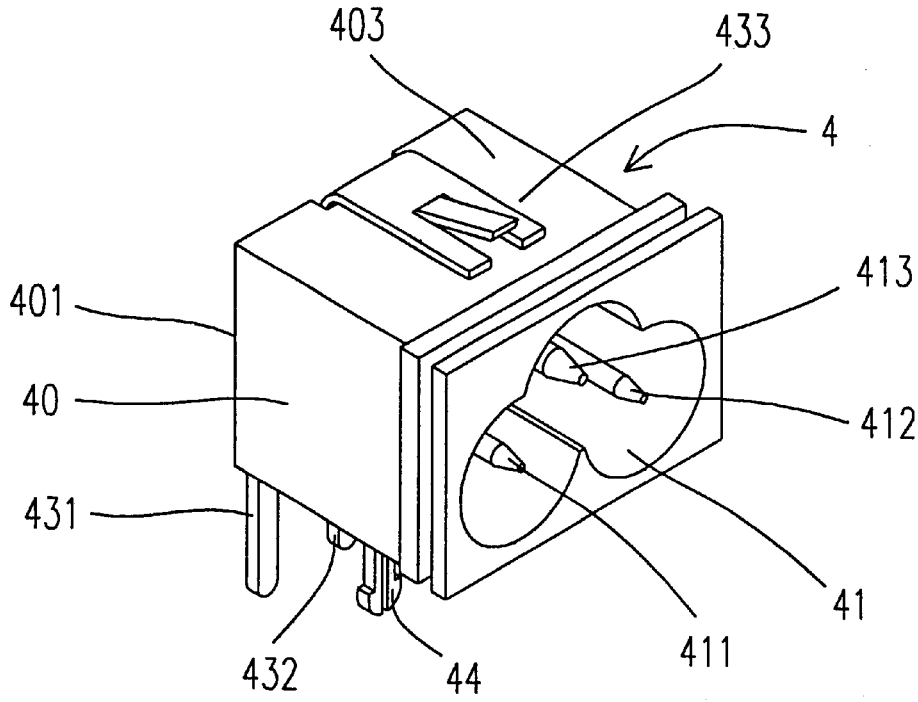
Fig. 2(a)(PRIOR ART)
FIGS. 2(*a*) and 2(*b*) are respectively perspective and rear views of an AC connector according to prior art.
Figure 2B:
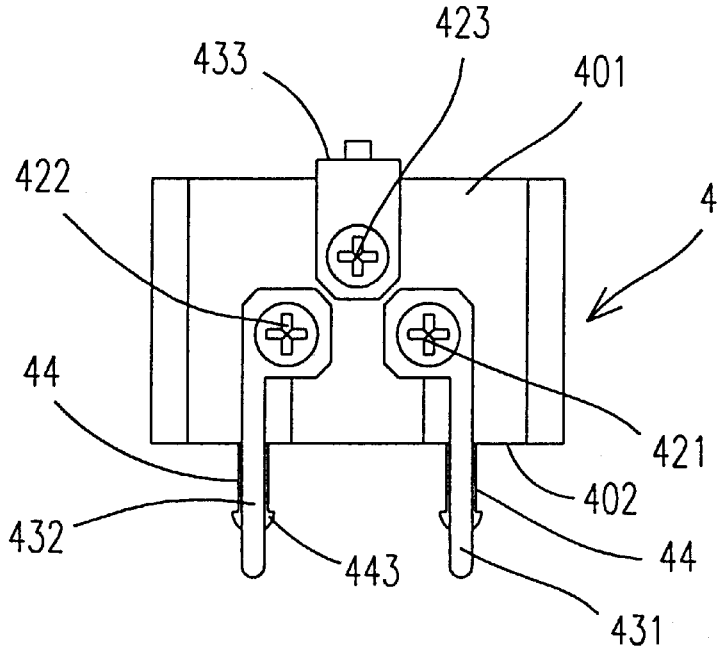
Fig. 2(b)(PRIOR ART)

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1(*a*) through 4(*c*), is not intended to limit the scope of the invention, as claimed, but is merely representative of the presently preferred embodiments of the invention.

Figure 3A:
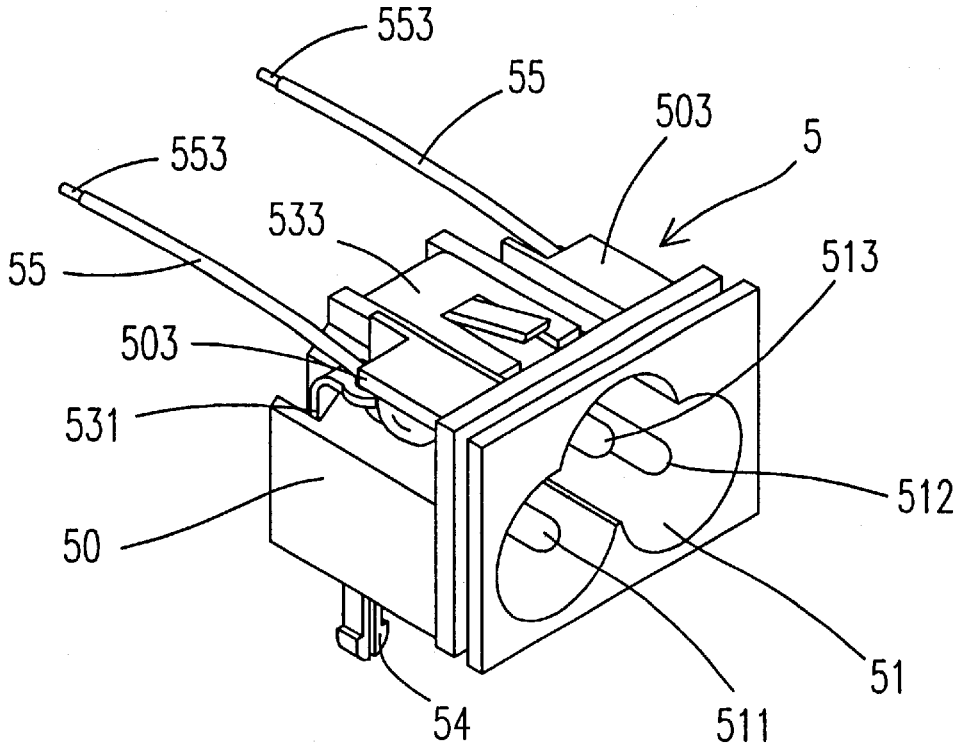
FIGS. 3(*a*) and 3(*b*) are respectively perspective and rear views of an AC connector according to a preferred embodiment of the present invention.
Figure 3B:
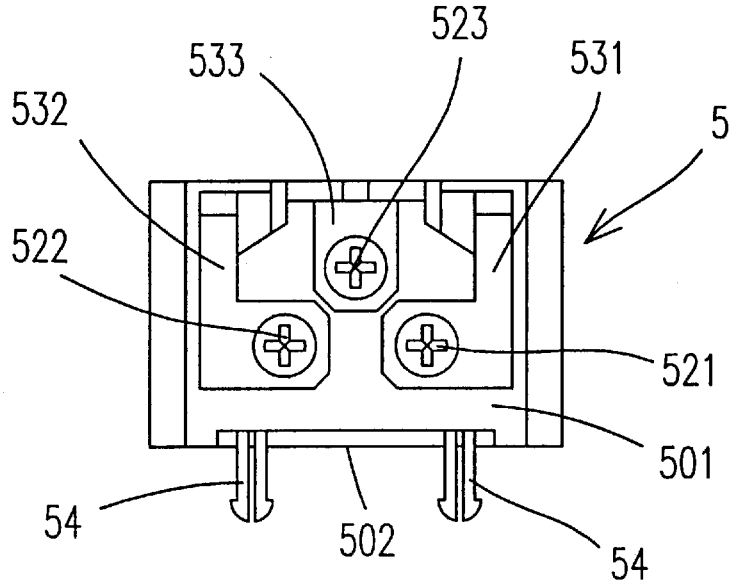

Please refer to FIGS. 3(*a*) and 3(*b*). The AC connector 5 of the present invention includes two power terminals 511 and 512 and a ground terminal 513, which are located in a cave 51 inside the main body 50 and pass through an aperture or apertures (not shown) on backside surface 501 of the main body 50. The terminals 511, 512, and 513 are respectively coupled with the pins 531, 532 and 533 via rivets 521, 522 and 523.

There are two supporting rods 54 extending from a bottom surface 502 of the main body 50, and these two supporting rods 54 are integrally formed with the main body 50. The supporting rods 54 will be inserted into the corresponding cavities on a circuit board (not shown). The principle and operation of the supporting rods 54 and circuit board are well known in the art and need not be further described in details herein. In this embodiment, the structure of the ground pin 533 is the same as that in the prior art.

It is noted that the power pin 531 and/or 532 are substantially L-shaped and extended upwards for a specified length and then bent to be in parallel with the top side of the main body 50. In addition, a wire 55 has one end welded onto the power pin 531 and the other end electrically connected to the circuit board.

Figure 4A:
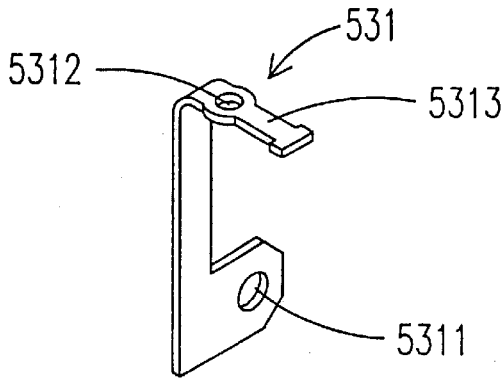
FIGS. 4(*a*) to 4(*c*) are diagrams illustrating the steps for fastening a wire onto a conducting pin of an AC connector according to a preferred embodiment of the present invention.
Figure 4B:
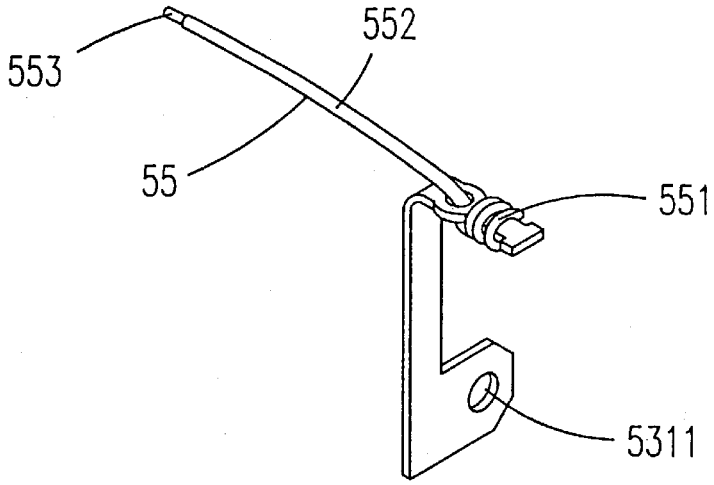
Figure 4C:
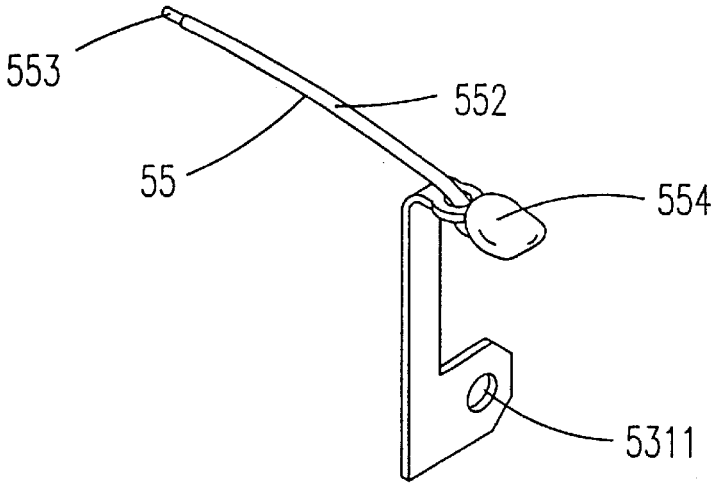

Please refer to FIGS. 4(*a*) to 4(*c*). As can be seen in FIG. 4(*a*), the power pin 531 has an opening 5311, a hole 5312, and a wire-securing part 5313. The wire-securing part 5313 is substantially T-shaped and will be coupled to the power terminal 511 through the opening 5311 by riveting. In FIG. 4(*b*), the wire 55 has an end with a bare part 551 and an insulated part 552, wherein the bare part 551 is uncovered, and the insulated part 552 is covered with an insulating material. In this embodiment, the whole bare part 551 and a portion of the insulated part 552 penetrate through the hole 5312. Then, the bare part 551 is wrapped around the wire-securing part 5313 for at least one turn. In FIG. 4(*c*), the bare part is fastened onto the wire-securing part 5313 by welding to apply solders 554 thereto. Furthermore, the other end 553 of the wire 55 will be electrically connected to the circuit board. In order to reduce the exposure of the welding point, depending on the wire-securing part 5313, a projecting plate 503 is integrally formed with the main body 50, as shown in FIG. 3(*a*).

It is of course conceivable that the ground pin 533 can have the same structure as that of the power pin 531.

As will be apparent from the above description, the AC connector of the present invention has the following advantages:

1. Since the pins 531, 532, and/or 533 are electrically connected with the circuit board via wires, the AC connector of the present invention can be applied to any circuit board that is provided with, for example, contacting pads;
2. Since the wire 55 is flexible, the disadvantages due to the thermal stress and mechanical stress can be greatly reduced; and
3. The particular structure of the pin and the process for fastening a wire onto the pin can enhance the fixation effect.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

The present invention may be embodied in other specific forms without departing from its spirit of essential characteristics. The described embodiments are to be considered in all respects only as illustrative and not restrictive. The scope of the invention is, therefore, indicated by the appended claims, rather than by the foregoing description. All changes that come within the meaning and range of equivalency of the claims are to be embraced within their scope.

What is claimed and desired to be secured by Letters Patent is:

1. A structure of a connector, comprising:

a main body;

at least one terminal located in a cave of said main body for accepting a power supply;

at least one pin electrically connected with said at least one terminal, each said pin having a hole and a wire-securing part; and at least one wire, each wire having a first end connected to said wire-securing part and a second end electrically connected to a circuit board, wherein said first end penetrates through said hole and is wrapped around said wire-securing part for at least one turn.

2. The structure according to claim 1, wherein said first end comprises a bare part and partially an insulated part.

3. The structure according to claim 2, wherein said bare part is uncovered, and said insulated part is covered with an insulating material.

4. The structure according to claim 1, further comprising at least one supporting rod extending from a bottom surface of said main body for being positioned on said circuit board.

5. The structure according to claim 4, wherein said supporting rod is integrally formed with said main body.

6. The structure according to claim 1, further comprising at least one projecting plate depending on said wire-securing part.

7. The structure according to claim 6, wherein said projecting plate is integrally formed with said main body.

8. The structure according to claim 1, wherein said pin is a power pin and said terminal is a power terminal.

9. The structure according to claim 1, wherein said pin is a ground pin and said terminal is a ground terminal.

10. A structure of an AC connector, comprising:

a main body;

at least one power terminal located in a cave of said main body for accepting an AC power supply;

at least one power pin electrically connected with said at least one terminal, each said power pin having a hole and a wire-securing part, and at least one wire, each wire having a first end connected to said wire-securing part and a second end electrically connected to a circuit board, wherein said first end penetrates through said hole and is wrapped around said wire-securing part for at least one turn.

11. The structure according to claim 10, wherein said first end comprises a bare part and partially an insulated part.

12. The structure according to claim 11, wherein said bare part is uncovered, and said insulated part is covered with an insulating material.

13. The structure according to claim 10, further comprising at least one supporting rod extending from a bottom surface of said main body for being positioned on said circuit board.

14. The structure according to claim 13, wherein said supporting rod is integrally formed with said main body.

15. The structure according to claim 10, further comprising at least one projecting plate depending on said wire-securing part.

16. The structure according to claim 15, wherein said projecting plate is integrally formed with said main body.

17. The structure according to claim 10, further comprising a ground terminal and a ground pin.

* * * * *